US010232915B2

(12) United States Patent
Jourdan et al.

(10) Patent No.: US 10,232,915 B2
(45) Date of Patent: Mar. 19, 2019

(54) SYSTEM FOR LAUNCHING AND RECOVERING MARINE AND SUBMARINE DEVICES ASSISTED BY TILTABLE PROTECTIVE COMPONENTS

(71) Applicant: THALES, Courbevoie (FR)

(72) Inventors: Michaël Jourdan, Plouzane (FR); Albert Tom, Ploudalmezeau (FR)

(73) Assignee: THALES, Courbevoie (FR)

( * ) Notice: Subject to any disclaimer, the term of this patent is extended or adjusted under 35 U.S.C. 154(b) by 0 days.

(21) Appl. No.: 15/520,395

(22) PCT Filed: Oct. 23, 2015

(86) PCT No.: PCT/EP2015/074624

§ 371 (c)(1),
(2) Date: Apr. 19, 2017

(87) PCT Pub. No.: WO2016/062870

PCT Pub. Date: Apr. 28, 2016

(65) Prior Publication Data

US 2017/0320547 A1 Nov. 9, 2017

(30) Foreign Application Priority Data

Oct. 24, 2014 (FR) ..... 14 02392

(51) Int. Cl.
*B63B 35/40* (2006.01)
*B63B 23/32* (2006.01)

(52) U.S. Cl.
CPC ..... *B63B 23/32* (2013.01); *B63B 35/40* (2013.01); *B63B 2035/405* (2013.01)

(58) Field of Classification Search
CPC ..... B63B 23/00; B63B 23/30; B63B 23/32; B63B 23/34; B63B 23/36; B63B 23/40; B63B 23/48; B63B 35/40; B63B 2035/405
USPC ... 114/44–51, 258, 259, 365, 366, 375, 376, 114/377, 378, 268
See application file for complete search history.

(56) References Cited

U.S. PATENT DOCUMENTS 2,568,330 A * 9/1951 Flippin ..... B63B 27/143 114/382
3,508,510 A * 4/1970 Frankel ..... B63B 27/143 114/260
3,596,623 A * 8/1971 Frankel ..... B63B 27/143 114/259

(Continued)

FOREIGN PATENT DOCUMENTS

CN 203 864 936 U 10/2014
DE 41 40 201 A1 6/1993
EP 2 551 185 A1 1/2013

*Primary Examiner* — Daniel V Venne
(74) *Attorney, Agent, or Firm* — Baker & Hostetler LLP

(57) ABSTRACT

A system for launching and recovering a marine or submarine device from a support vessel. The system includes a carriage and at least one protective component. Each protective component is connected to the carriage by a pivot connection of which the axis, when the device is secured to the vessel, is parallel to the surface of the water. The at least one protective component is suitable for raising the marine or submarine device partially out of the water during recovery and for placing the marine or submarine device in the water during a launch, by rotation of the protective component(s) about the carriage.

13 Claims, 3 Drawing Sheets

(56) References Cited

U.S. PATENT DOCUMENTS

| | | | | |
|---|---|---|---|---|
| 5,253,605 | A * | 10/1993 | Collins | B63B 21/66 114/258 |
| 6,779,475 | B1 * | 8/2004 | Crane | B63B 27/10 114/258 |
| 6,843,198 | B1 * | 1/2005 | Witbeck | B63B 25/006 114/258 |
| 7,156,036 | B2 * | 1/2007 | Seiple | B63B 27/36 114/254 |
| 8,430,049 | B1 | 4/2013 | Tureaud et al. | |
| 8,752,494 | B2 * | 6/2014 | Soreau | B63B 23/32 114/258 |
| 8,967,067 | B2 * | 3/2015 | Soreau | B63B 23/32 114/258 |
| 2008/0202405 | A1 * | 8/2008 | Kern | B63B 23/30 114/259 |
| 2012/0192780 | A1 * | 8/2012 | Soreau | B63B 23/32 114/259 |
| 2013/0025521 | A1 | 1/2013 | Jezequel | |
| 2014/0041570 | A1 | 2/2014 | Johansson | |

* cited by examiner

SYSTEM FOR LAUNCHING AND RECOVERING MARINE AND SUBMARINE DEVICES ASSISTED BY TILTABLE PROTECTIVE COMPONENTS

CROSS-REFERENCE TO RELATED APPLICATIONS

This application is a National Stage of International patent application PCT/EP2015/074624, filed on Oct. 23, 2015, which claims priority to foreign French patent application No. FR 1402392, filed on Oct. 24, 2014, the disclosures of which are incorporated by reference in their entirety.

FIELD OF THE INVENTION

The present invention is in the maritime field and relates to a system for launching and recovering marine or submarine devices (Launch And Recovery System (L.A.R.S.)). The launch and recovery system being capable on the one hand of raising the device from the water as a towing system on board a support vessel and on the other hand of lowering the device from the support vessel onto the sea. It notably applies to launching towed or autonomous submarine devices, the latter being provided with a temporary connection to the launch and recovery system during the launch and recovery phases.

BACKGROUND

The operations of launching and recovering a marine or submarine device from or to a support vessel also responsible for the transportation of the device generally include a critical phase, especially in a choppy sea conditions. That phase consists in the passage from the totally out of the water state in which the device is fastened to a handling means employed by the launch and recovery system to the totally submerged state in which the device no longer has any connection with the handling means of the launch and recovery system, and vice versa. In fact, it is during these critical phases that the ocean swell is the most dangerous to the integrity of the device, the device being agitated by the motion swell when it is close either to the structure of the vessel or to that of the lifting and handling means of the launch and recovery system, with the attendant risk of striking the vessel and/or the launch and recovery system. This is the case in particular for a marine or submarine device in the launch or recovery phase when the device is partly in the water. In this regard, the device movements are not yet (or no longer) completely controlled by the lifting and handling means of the launch and recovery system.

Accordingly, where autonomous devices, not towed by the vessel, are concerned, one known solution consists in providing mooring means on the hull of the device, for example securing means, said securing means being such that the device can be lifted whilst remaining in a horizontal position. Launching and recovery can then be carried out using a winch mounted on a mobile gantry placed at the stern of the vessel, for example, or a crane, the gantry or the crane making it possible to position the lifting winch over the recovery area. Thereafter launching and raising are effected vertically, which limits the possibilities of collision with the vessel during raising or lowering. Alternatively, the device can be lifted by placing it in a cradle type device itself including appropriate securing points.

This type of solution is applicable, notably autonomously, to devices towed from the center but is not easily applicable to devices towed from the front, however, in that, for obvious reasons of efficacy, the aim is to tow and to handle the device using a single cable. Handling by means such as those described above using a single cable proves delicate because it leads to the device passing from the vertical position to the horizontal position during launch and conversely during recovery. This handling moreover necessitates complementary operations the object of which is, after the device is lifted and positioned above the deck of the vessel, to deposit the device flat on the deck of the vessel or more generally in a storage area. These operations generally necessitate the intervention of human operatives, which intervention is rendered more delicate and more dangerous in a heavy sea. In the case of devices towed from the front, the solution that is generally preferred consists in using a handling cable temporarily attached above the center of gravity of the device.

A solution that is also used provides handling based on the placement of means including an inclined ramp on which the device slides onto the surface of the water or to leave it and return to the vessel. The ramp is generally configured to guide the device along a rectilinear trajectory, which prevents the device from being able to move laterally. However, a ramp of this kind is not generally suitable for use in a heavy sea: lateral movements of the device can then damage the ramp.

Using such means advantageously makes it possible to launch and to deploy the device behind the vessel by allowing the towing cable to play out and, conversely, to recover the device on board the vessel by winding in the cable, for example onto the drum of a winch. In this way the device towed by the vessel can be launched and recovered when the vessel is moving so that the device is naturally positioned on the axis of forward movement of the vessel.

Various solutions have been developed to alleviate these problems of coming into contact, generally suited to a given type of device. These known solutions generally consists in reinforcing the structure of the device, principally the nose, so that the nose resists impacts following entry into contact with the end of the ramp. It also consists in using means for minimizing these impacts, in particular configuring the ramp so that an end of the ramp is situated below the surface of the water so that the device floating on the surface comes into contact with an inclined surface of the ramp and not the end of the ramp. Solutions of this kind nevertheless prove inadequate in a heavy sea because of a slamming effect of the waves is accentuated by the movement of the vessel.

Other solutions have been developed (see for example EP 20110793422 and U.S. Pat. No. 8,430,049B1) in which the vessel incorporates a tiltable articulated ramp. The inclination of the ramp makes it possible to control the submerged part of the ramp. Once the ramp is submerged, the device is towed over an abutment that separates the ramp from the surface of the water. Moreover, in a heavy sea the ramp may come out of the water.

The foregoing solution is effective but cannot be fitted to all vessels. In fact, many vessels cannot support a weight necessary for installation of the equipment linked to the operation of a tiltable articulated ramp. The problem solved by the present invention is to cause the marine or submarine device to pass over a step situated between the end of the ramp and the water, notably when a small vessel is used, for example less than 50 meters long and preferably less than 20 meters long, incapable of supporting the installation of equipment that is too heavy, such as a tiltable articulated ramp as described in the prior art.

SUMMARY OF THE INVENTION

The present invention includes a system comprising a ramp and a device for launching and recovering a marine or submarine device from and to a support vessel, the device for launching and recovering including a carriage and at least one protective component, characterized in that:

each of said protective components is connected to the carriage by a pivot connection of which the axis is parallel to the surface of the water when said device is secured to said vessel;

at least one of said protective components is adapted to raise said marine or submarine device partially or totally out of the water during a recovery and to place said marine or submarine device in or partially in the water during a launch by rotation of said protective component about said carriage;

said carriage and said ramp are connected by a sliding connection;

said ramp is fastened to said vessel;

at least one of said protective components is adapted to raise or to deposit said marine or submarine device by contact with one or more of at least a wing of said marine or submarine device, at least one lateral protuberance of said marine or submarine device, and the hull of said marine or submarine device;

said system includes at least one sliding zone situated along said ramp, in contact with said protective part and fastened to said vessel, and in that at least one of said protective components is adapted to cooperate with said sliding zone to cause said marine or submarine device to move from a support of at least one of said protective components to a support of said ramp or from said support of said ramp to said support of at least one of said protective components.

The system advantageously comprises at least two of said protective components fastened together.

The protective component or each of said protective components advantageously comprises a protective part and an arm connected by a mechanical connection such that said arm or each of said arms is connected by one of said pivot connections to said carriage.

Each of said protective parts advantageously comprises at least one curved part and is adapted to limit the movements of said marine or submarine device.

At least one part of one of said protective parts of the system is advantageously hollowed out so as not to come into contact with more fragile parts of the marine or submarine device.

The pivot connection connecting each protective component to the carriage is advantageously freely rotatable.

At least one of said protective parts of the system advantageously includes at least one roller mounted at one of its ends and pivoting about a second axis parallel to the surface of the water when said system is secured to said vessel.

At least one of said protective parts advantageously includes at least one roller mounted on a part of said protective part adapted to cooperate with said sliding zone and pivoting about a second axis parallel to the surface of the water when said system is secured to said vessel.

The vessel advantageously includes traction means adapted to control the sliding of said marine or submarine device on said ramp. The carriage of said system can be in direct or indirect contact with said marine or submarine device during recovery or launch of said marine or submarine device.

The marine or submarine device is advantageously autonomous and at least one of said protective components includes an attachment device enabling connection of said autonomous submarine device at least to said protective component.

The traction means of the system advantageously include a winch, a traction cable and drive means such that said traction cable is fastened to said marine or submarine device, is driven by said winch, itself fastened to said support vessel and such that the carriage includes a fairlead guiding said traction cable on the axis of the ramp.

The system advantageously comprises at least one launch and recovery raising element fastened to at least one of said sliding zones in which at least one of said protective components is able to cooperate with at least one of said launch and recovery raising elements to cause said marine or submarine device to move from a support of at least one of said protective components to a support of said ramp or from said support of said ramp to said support of at least one of said protective components.

At least one of said sliding zones of the system is advantageously adapted to force the rotation of at least one of said protective components about said carriage when said carriage slides on said ramp, locally raising said marine or submarine device to facilitate its recovery or its launch.

The system advantageously also includes at least one launch and recovery raising element fastened to at least one of said sliding zones, adapted to force by contact the rotation of at least one of said protective components about said carriage when said carriage slides on said ramp, locally raising said marine or submarine device to facilitate its recovery or its launch.

The system is advantageously adapted to modify the attitude of said marine or submarine device during the launch or the recovery of said marine or submarine device.

The present invention also consists in a vessel equipped with at least one of said systems.

BRIEF DESCRIPTION OF THE DRAWINGS

The invention will be better understood and other advantages, details and features thereof will become apparent in the course of the following explanatory description given by way of example and with reference to the appended drawings, in which.

DETAILED DESCRIPTION

The following description presents a number of embodiments of the device of the invention: these examples are not limiting on the scope of the invention. These embodiments present both the essential features of the invention and additional features linked to the embodiments considered. For clarity, the same elements bear the same reference numbers in the various figures.

In the remainder of the text the terms front, rear, in front of and behind are defined relative to the longitudinal axis of the support vessel 6 oriented from the stern toward the bow of the support vessel 6.

Figure 1:
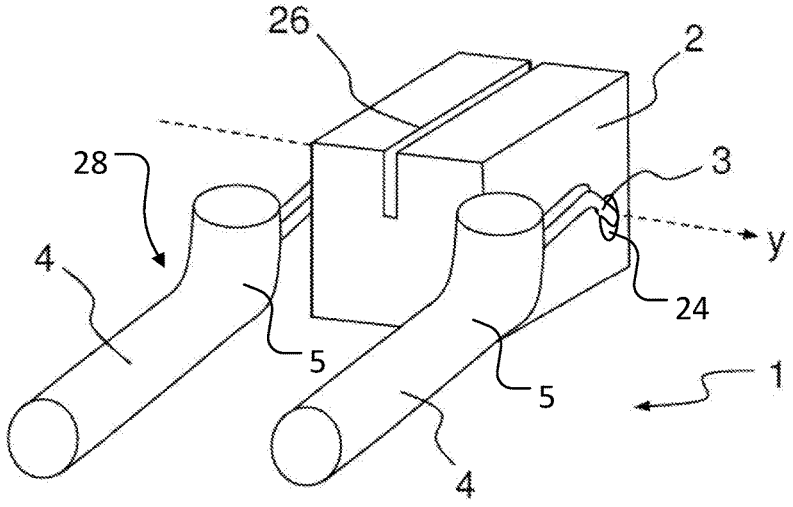
FIG. 1 is a diagrammatic perspective view of the launch and recovery device.

FIG. 1 presents a diagrammatic perspective view of the launch and recovery device 1. The launch and recovery device 1 comprises two elements: a carriage 2 and a protective component 5. The protective component 5 comprising two parts fastened together, a protective part 4 and an arm 3. In the FIG. 1 example, the two protective components 5 are installed one on each side of the carriage 2 and are fastened to each other. The protective components 5 can pivot about the carriage 2 about the axis y shown. That axis y is parallel to the surface of the water 25 when the launch and recovery device 1 is secured to a support vessel as described hereinafter in order to be able to lift or to deposit the marine or submarine device 7 carried by the protective parts 4. The protective parts 4 preferably having a curved part 28 to prevent forward or rearward movement of the marine or submarine device 7 during the maneuver. In one particular embodiment, the carriage 2 includes a part 26 that has the function of a fairlead.

Figure 2:
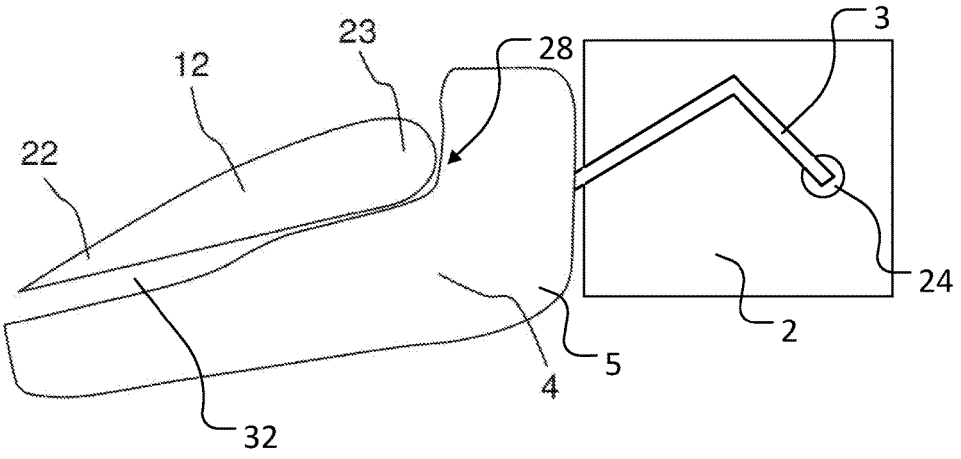
FIG. 2 is a diagrammatic profile view of one embodiment of a protective part supporting a wing of a marine or submarine device.

FIG. 2 presents a diagrammatic profile view of one embodiment of a protective part 4. The shape of this embodiment of the protective part 4 is in part curved and includes the curved part 28. One of the functions of the protective part 4 is to carry the marine or submarine device 7 and to limit or prevent movements of a front of the marine or submarine device 7 such as swerving, heaving, lurching, rolling, and yawing caused by external forces. In one particular embodiment of the invention, the rear of the protective part 4 features a hollowed out part 32. This configuration can be particularly useful in the case of contact between the protective part 4 and a wing 12 of the marine or submarine device 7.

The rear of the wing 22, defining a trailing edge, is thinner and mechanically weaker than the front part 23. In this embodiment, contact can occur only on the surface of the mechanically strongest part of the wing 12.

Figure 3:
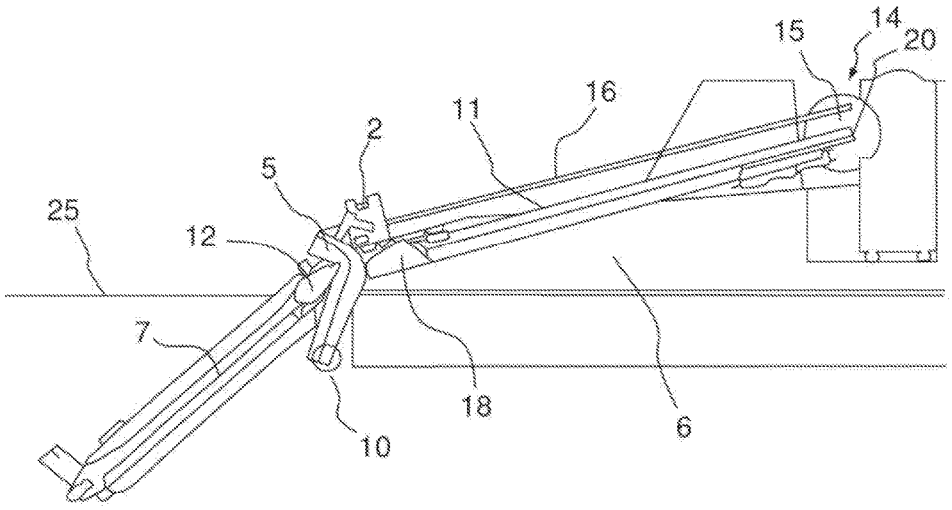
FIG. 3 is a profile view of the entire system at the moment of launch or recovery.

FIG. 3 presents a profile view of one embodiment of the whole of the launch and recovery device 1 (L.A.R.S.) during a phase of launching or recovering a marine or submarine device 7. In this embodiment a position of the protective component 5 is determined by three factors:

the pivot connection 24 with the carriage 2, described above, a difference between the force of gravity and the buoyant force (Archimedean upthrust) exerted on the protective component 5. In this particular embodiment, the protective component 5 is termed of the heavy type because it does not float, and the contact with the wing 12 of the marine or submarine device 7 that bears on the protective component 5.

In this configuration, the pivot connection 24 connecting one of the protective components 5 and the carriage 2 is freely rotatable. Although the rotation can be constrained by one of the above three factors, this configuration is also made to distinguish this embodiment from a particular embodiment in which the position of a protective component 5 can be determined primarily by a driving torque applied by first driving means to the protective component 5 via the pivot connection 24 connected to the carriage 2. In one particular embodiment of the invention, the protective component 5 can float and can for example be coupled to first driving means to control the submersion of the protective component 5.

In FIG. 3 the carriage 2 is situated at the bottom of the ramp 11, in a low or retracted position. The ramp 11 and the carriage 2 are connected by a sliding connection. In the phase of launching or raising the marine or submarine device 7, the front end of the marine or submarine device 7 is fastened to the traction cable 16. This traction cable 16 is inserted in the fairlead 26 of the carriage 2 and remains in close contact therewith, which has the advantageous effect of maintaining the axis of the marine or submarine device 7 on the axis of the ramp 11 as the marine or submarine device 7 moves along the ramp 11.

This remaining in contact occurs naturally because the carriage 2 is a heavy component the weight of which, in the absence of the marine or submarine device 7, tends to cause the carriage 2 to descend along the ramp 11. During a launch, the carriage 2 therefore accompanies the movement of the marine or submarine device 7. In one particular embodiment of the invention, the carriage 2 includes second driving means that enable it to force the descent along the ramp 11 in order to remain in contact with the marine or submarine device 7 during its recovery or launch.

The marine or submarine device 7 is raised or lowered by traction means 14 consisting of the traction cable 16 fastened to the marine or submarine device 7 and a winch 15 fastened to the support vessel 6 that enables the traction cable 16 to be wound in during a recovery phase or the traction cable 16 to be paid out during a launch phase with a third driving means 20 able to impose a second driving torque on the winch 15. In one particular embodiment, the marine or submarine device 7 can be an autonomous marine or submarine device. In this case, the marine or submarine device 7 is provided with a temporary connection during the launch and recovery phases. In this regard, the connection between the traction cable 16 and the marine or submarine device 7 is termed indirect. During the use of an autonomous marine or submarine device, this embodiment can be combined with or replaced by an embodiment in which at least one of the protective components 5 has a device for attaching it to the marine or submarine device 7 enabling the marine or submarine device 7 and the protective component 5 or protective components 5 to be connected when they come into contact at the commencement of recovery of the marine or submarine device 7, for example.

FIG. 3 also illustrates a raising component 18 situated at the edge of the ramp 11. The raising component 18 function is described in detail in the description of FIG. 4. FIG. 3 illustrates an example of the protective component 5 coming into contact with the raising component 18 during the recovery or launch phase.

Figure 4:
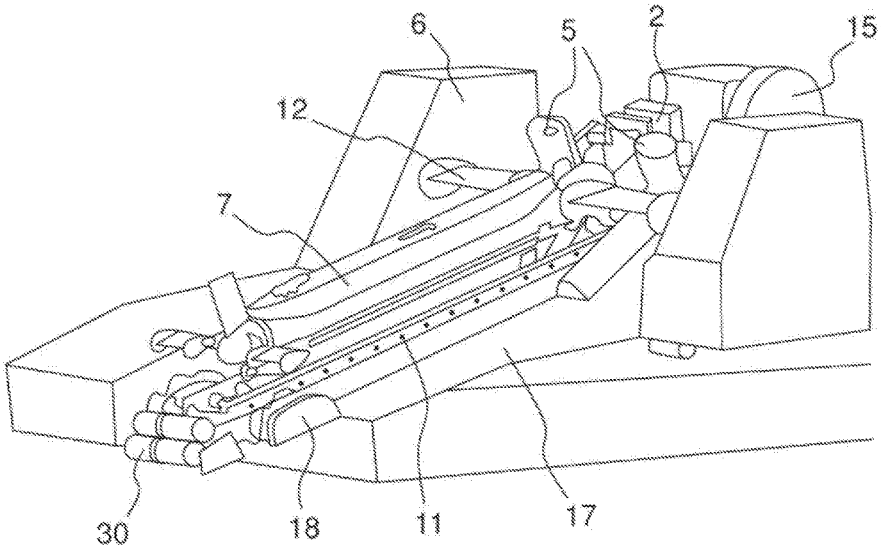
FIG. 4 is a perspective view of the entire system when the marine or submarine device is entirely mounted on a ramp.

FIG. 4 illustrates a diagrammatic perspective view of the entire system when the marine or submarine device 7 has been raised completely onto the ramp 11. According to an embodiment presented in FIG. 4, the marine or submarine device 7 has been recovered using the device described in FIG. 1 in which the two protective components 5 are installed one on each side of the carriage 2 and are fastened to each other. This feature enables the marine or submarine device 7 to pass over the step between the end of the ramp 11 and the surface of the water 25 without the nose or the front of the marine or submarine device 7 being in contact with the ramp 11. This method makes it possible to avoid impacts capable of damaging more fragile onboard components such as components or sensors, in particular sonar components.

FIG. 4 illustrates the sliding zone 17 situated along the ramp 11. The sliding zone 17 remains in contact with the protective component or protective components 5 when the carriage 2 slides along the ramp 11. According to one embodiment considered, the protective part 4 comprises a roller 10 mounted at one of its ends and pivoting about an axis parallel to the surface of the water 25, as illustrated in FIG. 3. This roller 10 enables the protective part 4 not to rub on the sliding zone 17 when the marine or submarine device 7 moves on the ramp 11. According to another embodiment of the invention, the protective part 4 comprises one or more rollers 10 mounted on a part of said protective part 4 able to cooperate with said sliding zone 17 and/or a raising component 18 pivoting about a second axis parallel to the surface of the water 25 when the system is secured to the support vessel 6. The one or more rollers 10 make it possible to prevent rubbing between the protective components 5 and the sliding zone 17 and/or one or more raising components 18. The one or more rollers 10 are for example arranged under the protective part or protective parts 4 relative to the frame of reference of the vessel.

According to the embodiment considered, the sliding zone 17 also enables the raising component 18, which is fastened to it, to be supported with the object of causing the protective component 5 to move through contact.

FIG. 4 moreover illustrates protection and sliding means 30 mounted on the ramp 11 and adapted to improve the movement of the marine or submarine device 7 along the ramp 11 because of the traction exerted by the traction cable 16 and gravity. The means are for example rollers disposed laterally on a bottom of the ramp 11 and on which the marine or submarine device 7 rolls.

Figure 5:
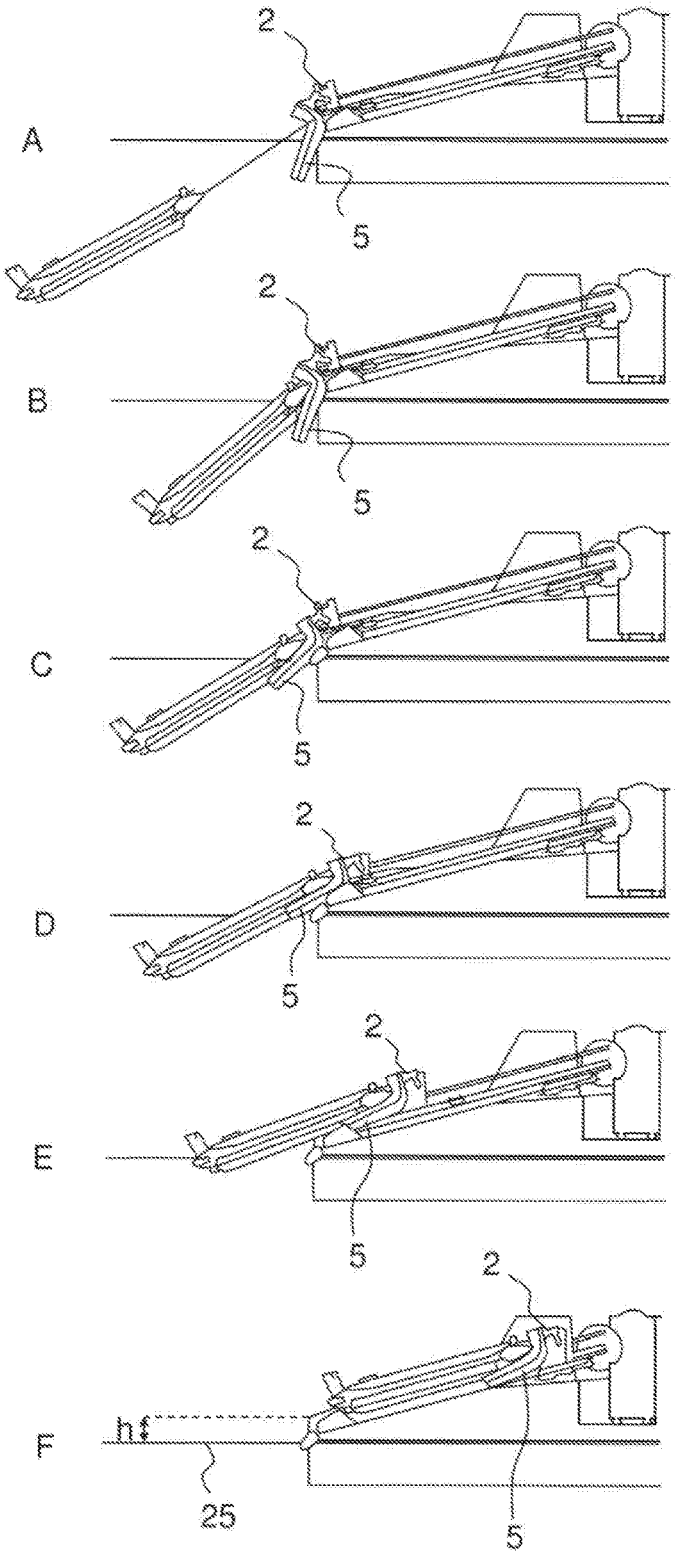
FIG. 5 is a sequence of diagrammatic profile views of the entire system describing a complete recovery phase.

FIG. 5 is a sequence of diagrammatic profile views of the entire the launch and recovery device 1 (L.A.R.S.) showing a complete phase of recovery of the marine or submarine device 7. One of the main technical problems can be illustrated by FIG. 5F. FIG. 5F illustrates the vertical step of height h present between the surface of the water 25 and the end of the inclined ramp 11. That vertical wall represents a source of impacts or shocks with the wall of the marine or submarine device 7 during launch and recovery thereof, notably when the front of the marine or submarine device 7 passes between the surface of the water 25 and the bottom of the ramp 11.

The effect of the present invention is to enable launching and recovery of the marine or submarine device 7 avoiding all contact between the step described above and the front of the marine or submarine device 7. The recovery sequence is described on the basis of FIG. 5A. FIG. 5A illustrates an approach phase of the marine or submarine device 7. The latter is submerged and fastened to the traction cable 16. It may however be noted that another embodiment may include a marine or submarine device 7 navigating on the surface during this recovery phase. The carriage 2 is placed in a retracted position, i.e. at the bottom end of the ramp 11, by gravity or by the second driving means. The protective components 5 are in the low position, i.e. pivoted downward, so as to be submerged to receive the marine or submarine device 7. In the FIG. 5A example, the principal axis of inertia of the protective components 5 makes an angle with the surface of the water 25 between 80° and 90° inclusive.

FIG. 5B illustrates the phase of the marine or submarine device 7 coming alongside. The traction cable 16 is wound in by the winch 15. In this embodiment the marine or submarine device 7 has wings 12. The traction by the traction cable 16 draws the wings 12 into abutment with the protective components 5.

FIG. 5C illustrates the phase of the front part of the marine or submarine device 7 mounting the step. The traction cable 16 continues to be wound in by the winch 15. The protective components 5 are constrained by the wings 12 of the marine or submarine device 7, by the sliding zone 17 and by the raising components 18: the protective components 5 then pivot about the carriage 2, their rotation being forced by the sliding zone 17 and/or a raising component 18. This rotation of the protective components 5 raises the front of the marine or submarine device 7 to the level of the ramp 11. The front of the marine or submarine device 7 does not at this time touch any component of the launch and recovery device 1 (L.A.R.S.), which makes it possible to protect the sensors from potentially destructive shocks.

FIGS. 5D and 5E illustrate the continued raising of the marine or submarine device 7 on the ramp 11. In FIG. 5D, the traction cable 16 continues to be wound in by the winch 15. The protective components 5 continue to pivot about the carriage 2 as the carriage 2 slides forward along the ramp 11. The protective components 5 slide, or in one particular embodiment roll, on the raising component 18, enabling the front of the marine or submarine device 7 to be raised further. The body of the marine or submarine device 7, stronger than its front, bears on protection and sliding means 30 of the ramp 11, in this instance rollers.

In FIG. 5E, the traction cable 16 continues to be wound in by the winch 15. When traction is applied, the marine or submarine device 7 bears on the protection and sliding means 30 of the ramp 11 until the marine or submarine device 7 rests on the ramp 11. The contact between the protective components 5 and the raising components 18 ceases and the protective components 5 slide or roll on the sliding zones 17.

FIG. 5F illustrates the marine or submarine device 7 raised to the end of the ramp 11. The protective components 5 are no longer in their raised position. The front of the marine or submarine device 7 then rests on the ramp 11 via its body. The protective components 5 remain in contact with the wings 12 and therefore notably limit or prevent rolling of the marine or submarine device 7.

The attitude of the marine or submarine device 7 varies during launch or recovery as a function of its initial attitude and loads imposed by the system. In embodiments of the invention, the normal maximum attitude variation of the marine or submarine device 7 may be between 0 and 90° inclusive. The system is able to modify the attitude of said marine or submarine device during launch or recovery of said marine or submarine device.

In one particular embodiment of the invention, the marine or submarine device 7 does not comprise either wings 12 or lateral protuberances. The recovery and launch phases are analogous to those illustrated in FIG. 5: in this embodiment, the protective part or protective parts 4 are directly in contact with the hull of the marine or submarine device 7.

The invention claimed is:

1. A system comprising a ramp and a device for launching and recovering a marine or submarine device from a support vessel, said device for launching and recovering comprising:

a carriage, said carriage sliding along said ramp, said ramp being arranged on said support vessel; and at least one protective component, each at least one protective component having a protective part, each at least one protective component is pivotally connected to the carriage about an axis that is parallel to a surface of water when said device for launching and recovering is secured to said support vessel;

at least one of said protective components raise said marine or submarine device partially or totally out of the water during a recovery and lower said marine or submarine device in or partially in the water during a launch by rotation of said at least one protective component about said carriage;

at least one of said protective components raise or lower said marine or submarine device by contact with at least one of the following:

at least a wing of said marine or submarine device, at least one lateral protuberance of said marine or submarine device, and a hull of said marine or submarine device;

said system includes at least one sliding zone situated along said ramp, the at least one sliding zone is in contact with said protective part and fastened to said support vessel, and wherein at least one of said protective components contact said sliding zone to cause said marine or submarine device to move from a position where said marine or submarine device is supported by at least one of said protective components to a position where said marine or submarine device is supported by said ramp; and wherein at least one of said protective components operate with said sliding zone to cause said marine or submarine device to move from a position where said marine or submarine device is supported by said ramp to a position where said marine or submarine device is supported by at least one of said protective components.

2. The system as claimed in claim 1 comprising at least two of said at least one protective component that are fastened together.

3. The system as claimed in claim 1, wherein said at least one protective component comprises the protective part and an arm, and said arm or each of said arms is pivotally connected to said carriage.

4. The system as claimed in claim 1, wherein said protective part comprises at least one curved part to limit movements of said marine or submarine device.

5. The system as claimed in claim 1, wherein at least one of said protective parts comprises a hollowed out portion to limit contact with a sensor of a sonar of the marine or submarine device.

6. The system as claimed in claim 1, wherein said at least one protective component is freely rotatable with respect to the carriage.

7. The system as claimed in claim 1, wherein at least one of said protective parts includes at least one roller having ends, the at least one roller mounted at the ends and pivoting about a second axis parallel to the surface of the water.

8. The system as claimed in claim 1, comprising at least one roller mounted on said protective part to pivot about a second axis parallel to the surface of the water.

9. The system as claimed in claim 1 comprising traction means to control a sliding of said marine or submarine device on said ramp.

10. The system as claimed in claim 1, comprising an attachment to connect said marine or submarine device at least to said protective component.

11. The system as claimed in claim 9, wherein said traction means include a winch, a traction cable, and drive means such that said traction cable is fastened to said marine or submarine device and is driven by said winch, said winch being fastened to said support vessel, and the carriage includes a fairlead for guiding said traction cable along an axis of the ramp.

12. The system as claimed in claim 1, wherein the system modifies an attitude of said marine or submarine device during launch or recovery of said marine or submarine device.

13. An assembly comprising the support vessel and the system according to claim 1, the ramp being secured to said support vessel.

* * * * *